US008452035B2

(12) United States Patent
Arndt et al.

(10) Patent No.: US 8,452,035 B2
(45) Date of Patent: May 28, 2013

(54) HEARING DEVICE AND METHOD FOR SETTING THE HEARING DEVICE FOR FEEDBACK-REDUCED OPERATION

(75) Inventors: Georg-Erwin Arndt, Obermichelbach (DE); Jens Hain, Kleinsendelbach (DE)

(73) Assignee: Siemens Medical Instruments Pte. Ltd., Munich (DE)

( * ) Notice: Subject to any disclaimer, the term of this patent is extended or adjusted under 35 U.S.C. 154(b) by 137 days.

(21) Appl. No.: 13/050,093

(22) Filed: Mar. 17, 2011

(65) Prior Publication Data

US 2011/0228960 A1 Sep. 22, 2011

(30) Foreign Application Priority Data

Mar. 17, 2010 (DE) ..... 10 2010 011 729

(51) Int. Cl.
*H04R 25/00* (2006.01)

(52) U.S. Cl.
CPC ..... *H04R 25/00* (2013.01); *H04R 2225/49* (2013.01)
USPC ..... 381/313; 381/318; 381/320

(58) Field of Classification Search
USPC ..... 381/312, 313, 314, 317, 318, 320, 381/321
See application file for complete search history.

(56) References Cited

U.S. PATENT DOCUMENTS

| | | | | |
|---|---|---|---|---|
| 7,688,990 | B2 | 3/2010 | Hellgren et al. | |
| 2004/0240682 | A1 | 12/2004 | Fischer | |
| 2006/0239484 | A1 | 10/2006 | Hamacher et al. | |
| 2008/0253596 | A1 * | 10/2008 | Klinkby et al. | 381/313 |
| 2008/0298615 | A1 | 12/2008 | Klinkby et al. | |
| 2009/0067651 | A1 | 3/2009 | Klinkby et al. | |

FOREIGN PATENT DOCUMENTS

| | | | |
|---|---|---|---|
| DE | 19844748 | A1 | 10/1999 |
| DE | 10313330 | A1 | 10/2004 |
| DE | 102005019149 | B3 | 8/2006 |
| WO | 2005091675 | A1 | 9/2005 |
| WO | 2007098808 | A1 | 9/2007 |
| WO | 2007113282 | A1 | 10/2007 |

* cited by examiner

*Primary Examiner* — Tuan D Nguyen
(74) *Attorney, Agent, or Firm* — Laurence A. Greenberg; Werner H. Stemer; Ralph E. Locher

(57) ABSTRACT

Sound from the receiver of a hearing device may be fed back to its microphones via acoustic feedback paths, which may cause undesirable whistling. It is particularly difficult to predict the creation of feedback in a microphone array with adjustable directional characteristic. This is because the stability of the system then is dependent on a directional parameter by way of which the directional characteristic is fixed. The invention enables feedback-free operation of such a hearing device. A prescribed stability condition is used to establish for which values of the directional parameter feedback-free operation is possible. The directional parameter is then restricted to these values during operation of the hearing device. As an alternative thereto, a value for a strength of a feedback effect is established for a current value of the directional parameter and the directional parameter or a control parameter for the purpose of feedback suppression is then set as a function of the established value.

13 Claims, 3 Drawing Sheets

HEARING DEVICE AND METHOD FOR SETTING THE HEARING DEVICE FOR FEEDBACK-REDUCED OPERATION

CROSS-REFERENCE TO RELATED APPLICATION

This application claims the priority, under 35 U.S.C. §119, of German patent application DE 10 2010 011 729.3, filed Mar. 17, 2010; the prior application is herewith incorporated by reference in its entirety.

BACKGROUND OF THE INVENTION

Field of the Invention

The invention relates to a method for setting a hearing device in order to allow feedback-reduced operation of the hearing device. The invention also relates to a hearing device in which such a feedback-reduced operation can be made possible. Here, at least one directional parameter for fixing a directional characteristic of a microphone array of the hearing aid can be set in the hearing device. The term hearing device as used herein is understood to mean a hearing aid, in particular, but also includes other portable acoustic appliances such as headsets, headphones, or the like.

Hearing aids are portable hearing devices used to support the hard of hearing. In order to accommodate the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids and implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually designed as an electroacoustic transducer, e.g. a miniaturized loudspeaker, or as an electromechanical transducer, e.g. a bone conduction receiver. The amplifier is usually integrated into a signal-processing unit. This basic design is illustrated in FIG. 1 using the example of a behind-the-ear hearing aid. One or more microphones 2 for recording the sound from the surroundings are installed in a hearing-aid housing 1 to be worn behind the ear. A signal-processing unit (SPU) 3, likewise integrated into the hearing-aid housing 1, processes the microphone signals and amplifies them. The output signal of the signal-processing unit 3 is transferred to a loudspeaker or receiver 4, which emits an acoustic signal. If necessary, the sound is transferred to the eardrum of the aid wearer using a sound tube, which is fixed in the auditory canal with an ear mold. A battery 5, likewise integrated into the hearing-aid housing 1, supplies the hearing aid and, in particular, the signal-processing unit 3 with energy.

In the case of a hearing device, more particularly a hearing aid, the sound generated by the receiver may escape the auditory canal of the user and, once again, reach a microphone of the hearing device. The possible paths along which the sound can be acoustically transmitted together form an acoustic feedback path from the receiver to the microphone. By way of example, an earpiece for fixing a sound tube in an auditory canal may be provided with a through opening, a so-called vent, for airing the auditory canal. However, the sound from the receiver can also then emerge from the auditory canal through such openings. Thus, accordingly this may result in a feedback path that leads through this vent. A feedback path can also lead through regions of the skull of the aid wearer should these regions be excited to oscillate by e.g. sound waves from the receiver and should the sound signal propagate as body-borne sound. In the case of bone-conduction hearing aids, the receiver already generates a body-borne sound, which is fed back under certain circumstances.

If the sound signal from the receiver is registered by a microphone, it may be amplified in the hearing device and be reemitted by the receiver. In such a case, the acoustic feedback path and the signal-processing means of the hearing aid together form a feedback loop. In the context of the description of the invention, the transmission of a signal along a feedback loop is referred to as a feedback effect.

The feedback effect is critical if, over the feedback loop, there is an overall gain of the signal that is greater than one. If, for example, an ear mold of the hearing device has not been inserted into the auditory canal as envisaged, such that an air gap remains between the ear mold and the skin of the aid wearer, this may result in a feedback path that mainly leads through this gap. Then there is particularly low damping of the fed-back sound. The fed-back sound has a correspondingly high volume at the microphone. If the received microphone signal is subsequently amplified and once again converted into sound by the receiver, this can lead to the receiver generating a sound that becomes louder and louder. A feedback loop with a gain greater than one can result in self-excitation of the hearing device, which leads to whistling, which is referred to as feedback in the context of the description of the invention. Such whistling is generally considered bothersome by the aid wearer and by persons in his/her vicinity.

Another method for describing a hearing device and regions in the vicinity thereof, through which the feedback paths run, emerges from considering the hearing device and the vicinity thereof together as a system. This system is referred to as unstable if it can be excited to feedback by sound impinging on the hearing device from a surrounding area. Conversely, a stable system always allows feedback-reduced operation of the hearing device. A mathematical description of such a system is referred to here as an overall transfer function of the system.

The probability of feedback increases particularly if the signal-processing unit of the hearing device amplifies the microphone signals very strongly in a few frequency regions in order to compensate for a loss of hearing of the aid wearer. Gain caused by feedback is also referred to as critical gain.

The directional characteristic of a microphone or a microphone array of the hearing device also influences the generation of feedback. The directional characteristic describes the extent to which, depending on the direction of incidence of the sound on the hearing device, a sound signal is damped by the signal-processing means of the hearing device. Should sound that is fed back from the receiver impinge on the microphones from a direction with particularly strong damping according to the directional characteristic, this may be able to prevent feedback. By contrast, if fed-back sound reaches the microphones from a direction with particularly little damping according to the directional characteristic, this may even promote feedback.

It may be possible to set the directional characteristic by means of a directional parameter in the case of a microphone array made from a plurality of microphones. This hearing device can then allow the controlling of the value of the directional parameter as a function of e.g. parameters of the surroundings, and so a directional characteristic is respectively provided in different situations, e.g. during a conversation or in a concert, by means of which an aid wearer can perceive his/her surroundings particularly well.

Commonly assigned, German published patent application DE 103 13 330 A1 describes a method and a hearing aid with a directional microphone system, which has at least two microphones. A direction-dependent sensitivity of the directional microphone is determined by also weighting the microphone signals in different frequency bands. The method can thus effectively suppress at least one acoustic noise signal.

Commonly assigned U.S. patent application publication No. US 2004/0240682 A1 and its counterpart German published patent application DE 198 44 748 A1 disclose a method for providing a directional characteristic and a hearing aid that has high noise suppression in continuously changing hearing situations. A mixer and adaptive correction units afford the possibility of achieving different directional characteristics. Furthermore, weighting signals, which are included in the calculations as gain values, can also support a pronounced directional characteristic.

Furthermore, a hearing-aid device is described in commonly assigned U.S. patent application publication No. US 2006/0239484 A1 and its counterpart German published patent application DE 10 2005 019 149 B3, which compensates for acoustic and electromagnetic feedback signals with the aid of an adaptive compensation apparatus. The hearing-aid apparatus has a weighting apparatus, by way of which the signal from the microphone and/or from the electromagnetic receiver is weighted.

SUMMARY OF THE INVENTION

It is accordingly an object of the invention to provide a hearing device and a method of operating the same in feedback suppression mode which overcome the above-mentioned disadvantages of the heretofore-known devices and methods of this general type and which provides for feedback-reduced operation of the hearing aid for a hearing aid in which a directional characteristic of a microphone array is dependent on a value of a directional parameter.

With the foregoing and other objects in view there is provided, in accordance with the invention, a method for operating a hearing device having a microphone array and the microphone array having a directional characteristic determined by a settable directional parameter, the method which comprises:

prescribing a stability condition, depending on the directional parameter, for feedback-reduced operation of the hearing device;

establishing those values of the directional parameter that satisfy the stability condition;

operating the hearing device and thereby restricting possible values for the directional parameter during operation of the hearing device to the established values.

In accordance with a variation, there is provided a method for operating a hearing device, in which a directional parameter for fixing a directional characteristic of a microphone array can be set as a first parameter and a control parameter for controlling an apparatus for the purpose of feedback suppression can be set as a second parameter, the method which comprises:

prescribing a measure for a feedback effect;

establishing a value for the measure based on a current value of the directional parameter; and setting at least one of the parameters as a function of the established value.

In other words, the hearing device can be operated by way of the methods according to the invention. The first of these methods relates to a hearing device with a microphone array, in which a directional parameter for fixing a directional characteristic of the microphone array can be set. In principle, such microphone arrays that can be set are known in many embodiments from the prior art.

As per the first method according to the invention, a stability condition is specified for feedback-reduced operation of the hearing device. By way of example, such a stability condition can be based on a calculation prescription that can be used to establish whether the system is stable within the above-described sense. A stability condition is always prescribed, where the value of the directional parameter decides whether said condition is satisfied or not. Then, according to the method, the stability condition is used to establish those values of the directional parameter that satisfy the stability condition. In a further step, the possible values for the directional parameter during operation of the hearing device are then restricted to the established values. In other words, those settings of the directional characteristic that promote feedback are prevented. This is achieved by only permitting the established values.

Which of the allowed values is actually set can be determined by another method. By way of example, one such method can be the previously mentioned method for optimizing the directional characteristic depending on surrounding parameters. The restriction to the established stability values then always advantageously ensures that the operation of the hearing device remains feedback-reduced.

By way of example, a stability condition can be that an overall gain resulting from running through a feedback loop is less than one. The overall gain is a variable that is dependent on the directional characteristic of the microphone array. However, an overall gain of less than one does not always have to be the condition for a stable, i.e. substantially feedback-free, operation. By way of example, if the hearing device is also provided with an algorithm for feedback suppression, a stability condition can consist in only preventing such feedback that can no longer be suppressed by the algorithm within a period of time acceptable to the aid wearer.

However, a stability condition may also consist in prescribing that the overall gain of the feedback loop must be significantly less than one. By way of example, this may be expedient if changes in the transfer function are expected and a substantially feedback-free operation should also still be ensured for such modified transfer functions. By way of example, a transfer function can change as a result of the hearing device slipping at an ear of the aid wearer.

Finally, a stability condition may also comprise the criterion that a measured value of a physical variable or a value of a control parameter lies in a correspondingly prescribed interval.

In a preferred embodiment of the first method according to the invention, a term of a denominator of an overall transfer function is prescribed, with the term comprising at least the directional parameter and a transfer function of a feedback path. Those values for the directional parameter are established that satisfy the stability condition that the term satisfies a predetermined criterion. The term preferably determines the position of a pole of the overall transfer function in the complex plane.

Here, it is particularly advantageous for the overall transfer function to comprise a transfer function of a feedback path as well. This also takes into account an influence of surroundings of the hearing device on the feedback behavior. Since the overall transfer function also comprises the directional parameter itself, this advantageously allows an analytic calculation of the stability value or an interval of stability values. A corresponding transfer function is preferably established for each microphone.

The method according to the invention is also advantageously developed by establishing the values as a function of a frequency of a signal. By way of example, this subsequently allows the provision of different stability values for individual channels in a filter bank. As a result, a different stability condition can be prescribed for each channel, without a directional characteristic in another channel needing to be restricted to an unnecessarily large degree in order to satisfy a stability condition in a first channel.

In a further advantageous embodiment of the method according to the invention, the overall transfer function is formed as a fraction A/B, with:

$$A=[1-\exp(-j\omega(\tau_e+\tau_i))]H_c \text{ and}$$

$$B=1-H_c[F_1(1+a\exp(-j\omega\tau_i))-F_2(a+\exp(-j\omega\tau_i))].$$

Here the overall transfer function includes the following terms:

a transfer function $F_1$ of a first feedback path and a transfer function $F_2$ of a second feedback path, a gain function $H_c$ of the hearing device, a frequency $\omega$ of a signal, a delay time $\tau_i$ and a weighting factor a as the directional parameter, by means of which two factors the directional characteristic of the microphone array is fixed, and a run time $\tau_e$ of sound between two microphones of the microphone array. The run time $\tau_e$ emerges from $\tau_e=d/c*\cos(\alpha)$, where d is a spacing between the two microphones and c is the speed of sound in air. The factor $\cos(\alpha)$ is the cosine of the angle of incidence $\alpha$ of the sound with respect to the hearing device. The gain function $H_c$ more particularly comprises a frequency response that is used to compensate for a loss of hearing of an aid wearer. The following holds true for the frequency of the surrounding signal: $\omega=2\pi f$, where f is a frequency measured in Hertz. The other variables in the overall transfer function can also be frequency dependent.

The overall transfer function A/B for the first time allows an analytic calculation of values for stable operation. Here, the weighting factor a should preferably be considered as the directional parameter. The development of the first method according to the invention is based on the discovery that a feedback-reduced or substantially feedback-free operation is often possible for whole intervals $a<a_0$. Accordingly, it advantageously then is only the boundary $a_0$ of the interval that needs to be established. Feedback-reduced operation then is reliably possible for each value in this interval. By precisely calculating values for the weighting factor, this advantageously ensures that a predetermined stability condition is observed and nevertheless the weighting factor is not restricted excessively.

As per an advantageous development of the method according to the invention, the overall transfer function can, in order to establish the values, be used to check for which values of the weighting factor a a value of a term $H_c[F_1(1+a\exp(-j\omega\tau_i))-F_2(a+\exp(-j\omega\tau_i))]$ is less than a stability threshold. This term can be used to calculate an interval of possible stability values for the weighting factor a in a simple fashion.

Additionally, the term can provide a measure for a strength of the feedback effect. By way of example, this measure makes it possible to establish how robust the hearing device is against feedback at a given value of the weighting factor a. Here, the robustness of a hearing device increases the more the transfer functions $F_1$ and $F_2$ and other variables contained in the term can vary without this resulting in unforeseen feedback. The value one is preferably used as stability threshold.

The variation outlined above, also referred here as a second method, relates to the operation of a hearing device, in which a directional parameter for fixing a directional characteristic of a microphone array can be set as a first parameter and a control parameter for controlling an apparatus for the purpose of feedback suppression can be set as a second parameter. A measure for a feedback effect is prescribed in the method. An example of such a measure is the previously described overall transfer function or the above mathematical term. The term can be used to establish a strength of the feedback effect, e.g. the feedback gain. A value for the measure is established on the basis of a current value of the directional parameter. At least one of the parameters is then set as a function of the established value.

The method can advantageously be used to set the directional characteristic or the feedback suppression in order to avoid or suppress feedback. In this respect, the prior art has merely disclosed a reduction in the gain of the receiver signal.

An advantageous development of the second method according to the invention emerges if a distance measure from a stability threshold, dependent on the directional parameter, is prescribed as a measure for the feedback effect and an increment for an adaptation algorithm of the unit for the purpose of feedback suppression is set as parameter. Here, an adaptation speed of the adaptation algorithm then is increased if the hearing device is operated in the vicinity of the stability threshold.

By way of example, the adaptation algorithm may be a component of a unit for suppressing feedback, as previously described above. The increment controls the adaptation speed of the algorithm. According to the development, the adaptation speed is increased if the value of the directional parameter reveals that the hearing device is operated in the vicinity of a stability threshold. Controlling the increment as a function of the value for the directional parameter is advantageous in that the adaptation speed is always particularly high when the risk of feedback is also high.

In a further embodiment of the method according to the invention, as a measure for the feedback effect, there is analysis relating to whether there is feedback and, in the step of setting, the current value of the directional parameter is changed until a feedback effect drops below a prescribed threshold. In particular, such a threshold is determined by virtue of the fact that a gain is less than one for a feedback loop such that existing feedback decays of its own accord.

With the above and other objects in view there is also provided, in accordance with the invention, a hearing device, in which a directional parameter for fixing a directional characteristic of a microphone array can be set as a first parameter and a control parameter for controlling an apparatus for the purpose of feedback suppression can be set as a second parameter. A control apparatus is provided in the hearing device according to the invention, which control apparatus is configured to operate the hearing device according to the above-noted method, or at least according to one of the two alternatives of the method according to the invention or one of the described developments thereof.

Thus, advantageously, the hearing device according to the invention can independently ensure a feedback-reduced operation by means of the control apparatus.

By way of example, a directional characteristic of a microphone array can be enabled by a superposition of a cardioid directional characteristic and an anti-cardioid directional characteristic. Here, provision can be made for an anti-cardioid directional characteristic component as a proportion of the overall directional characteristic of the microphone array to be determined by a weighting factor a. Then the overall directional characteristic can be set by way of the weighting factor a.

Other features which are considered as characteristic for the invention are set forth in the appended claims.

Although the invention is illustrated and described herein as embodied in a hearing device and method for setting the same for feedback-reduced operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
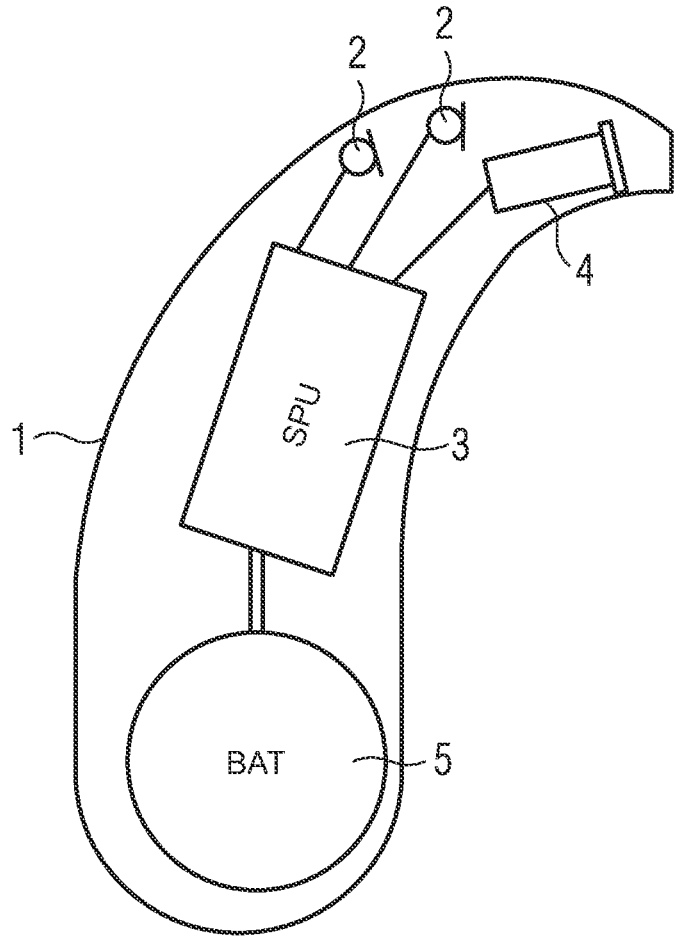
FIG. 1 PRIOR ART
FIG. 1 shows a schematic illustration of a prior art design of a behind-the-ear hearing aid, without a sound tube or ear piece.
Figure 2:
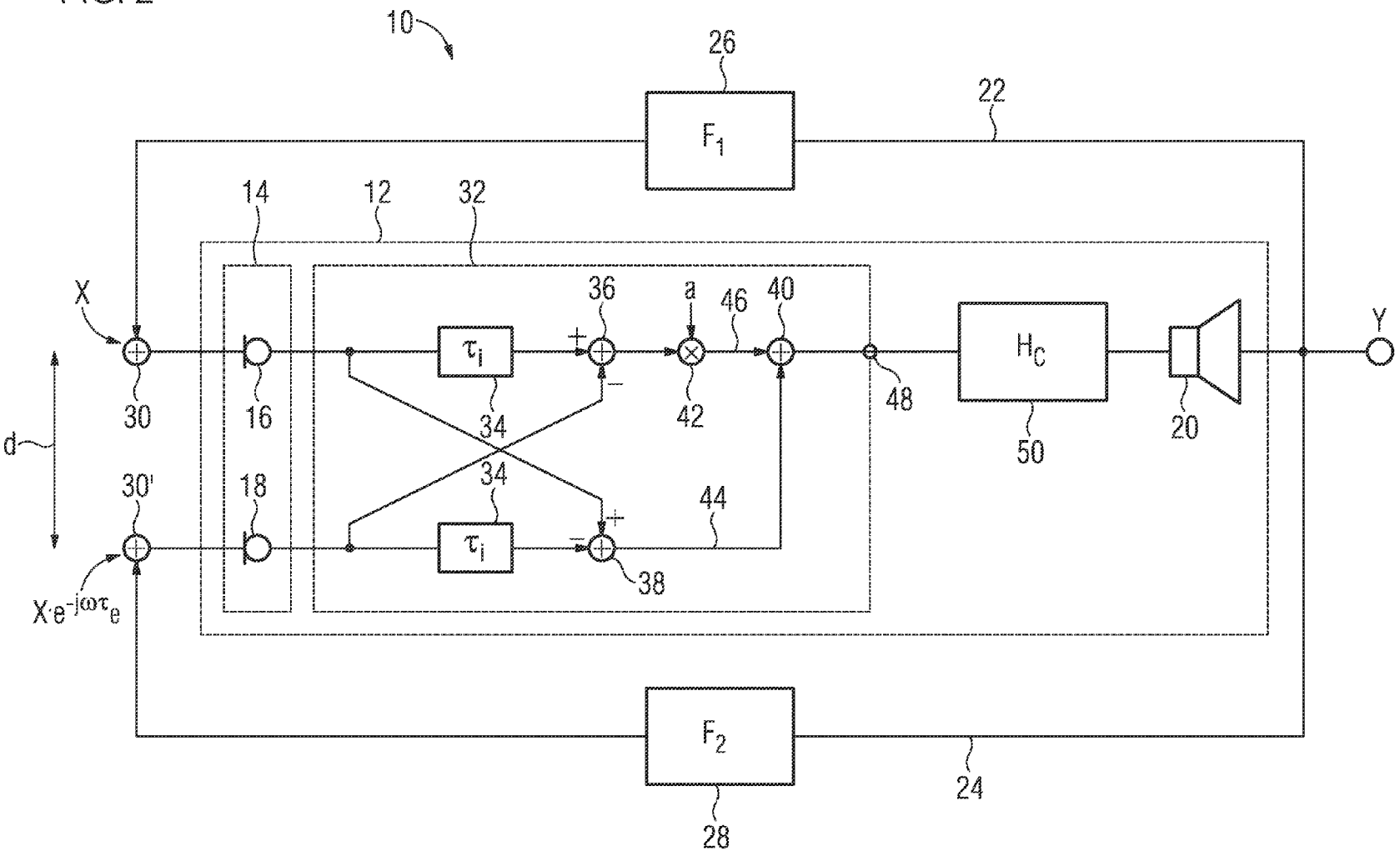
FIG. 2 shows a signal-flow diagram of a system that comprises an exemplary embodiment of the hearing device according to the invention.

Referring now to the figures of the drawing in detail and first, particularly, to FIG. 2 thereof, there is shown a hearing aid 12 with a microphone array 14 made up of two microphones 16, 18. The hearing aid 12 can be e.g. a behind-the-ear hearing aid, where a housing (not illustrated in any more detail in FIG. 2) with the microphone array 14 is situated behind an ear of an aid wearer.

By way of example, the hearing aid 12 can also comprise a sound tube and an ear mold. Here, the ear mold can be inserted into an auditory canal of the aid wearer. A receiver 20 of the hearing aid 12 generates a sound, which is routed into the auditory canal through the sound tube and the ear mold. Another type of earpiece may also be provided in place of an ear mold.

Air surrounding the hearing aid 12 and the ear of the aid wearer form hearing aid 12 surroundings, which, together with the hearing aid 12, form a system 10 in which there may be feedback. Feedback paths 22, 24 are formed through the surroundings and sound Y from the receiver 20 can reach the microphone array 14 via these feedback paths. The feedback paths 22, 24 for example comprise an acoustic propagation path that leads through an airing vent in the ear mold. When the sound signal Y propagates along the feedback path 22, the sound signal Y is modified according to a transfer function $F_1$, which is denoted by the reference sign 26 in FIG. 2. There is a transfer function $F_2$, denoted by the reference sign 28 in FIG. 2, for the feedback path 24.

The microphone 16 receives sound X from a sound source located in the vicinity of the aid wearer. After a time delay $\tau_e$, the sound X also reaches the microphone 18. The time delay $\tau_e$ is dependent on a spacing d between the microphones 16, 18 and on an angle $\alpha$ between the direction of propagation of the sound X and an axis of the microphone array 14, as described above. The sound X and the sound Y, which has passed over the feedback paths 22, 24, are superposed at the microphones 16, 18. This is indicated in FIG. 2 by addition symbols 30, 30'.

The hearing aid 12 has an apparatus 32 for generating a directivity of the microphone array 14. The microphones 16 and 18 themselves can each have an omnidirectional directivity, i.e. each individual microphone 16, 18 registers sound in an undirected fashion in this case. The apparatus 32 comprises delay elements 34, by means of which a microphone signal can be delayed by a delay time $\tau_i$. By way of example, such a delay can be brought about by changing a phase of a spectral component of the microphone signal. The apparatus 32 also contains adders 36, 38, 40, by means of which two signals can be superposed, i.e. added, in each case. In doing so, one of the input signals is inverted prior to the superposition in the adders 36, 38. This is indicated in FIG. 2 by a minus sign. The unit 32 moreover comprises a multiplier 42, by means of which a signal can be weighted, i.e. multiplied, by a weighting factor a.

The apparatus 32 provides a cardioid branch 44 and an anti-cardioid branch 46 as signal paths. A signal reaching the adder 40 via the cardioid branch 44 has signal components that are damped in accordance with a cardioid directional characteristic of the microphone array 14. A signal in which signal components are damped in accordance with an anti-cardioid directional characteristic of the microphone array 14 reaches the adder 40 via the anti-cardioid branch 46. A component of the signal of the branch 46 as a proportion of an added signal at the output 48 of the unit 32 is determined by the weighting factor a. The weighting factor a is a directional parameter of the apparatus 32.

The output 48 of the unit 32 is coupled to an amplifier 50 of the hearing aid 12. The amplifier 50 can amplify a signal as a function of a hearing curve of the aid wearer in order to compensate for a loss of hearing.

A signal path consisting of the feedback path 22 and the electrical path from the microphone 16 to the receiver 20 forms a first feedback loop. The feedback path 24 and the electrical signal path from the microphone 18 to the receiver 20 together form a second feedback loop. There is a feedback effect over the two feedback loops. Whether a signal leads to feedback in the previously described sense, i.e. to an audible whistling, is dependent on a gain along the feedback loops.

An overall transfer function Y/X=A/B emerges for the system 10, shown in FIG. 2, of hearing aid 12 and the surroundings thereof, wherein A and B are defined as previously described above. In the context of the variables A and B, it should still be mentioned that exp( ) is the exponential function and j is the imaginary unit, where j*j=−1.

The overall transfer function Y/X can be used to calculate a stability threshold of the system 10 as a function of values for the transfer functions $F_1$ and $F_2$. A stability condition for the system 10 is that the magnitude of the term $H_c[F_1(1+a\exp(-j\omega\tau_i))-F_2(a+\exp(-j\omega\tau_i))]$ is less than or equal to 1. Then the sound X produces no feedback. That is to say that although a sound Y of the receiver 20 reaching the microphone array 14 over the feedback paths 22 and 24 generates a feedback effect such that it can once again cause a microphone signal in the hearing aid 12, which can be processed again, the signal is always attenuated along the feedback loop to the extent that, over time, it decays of its own accord.

By contrast, if there is a value of greater than one for the term, for example because the weighting factor a was selected to be too large, this can lead to feedback, i.e. an audible whistling.

Parts of the specified term can also be examined individually. The factor $C_1=H_e(1+a\exp(-j\omega\tau_t))$ for $F_1$ and the factor $C_2=H_e(a+\exp(-j\omega\tau_t))$ for $F_2$ can for example each be examined as to whether they are greater than 1 or less than 1. If at least one of these factors is greater than 1, the stability threshold in the system 10 is reached earlier than in a system with a single, omnidirectional microphone. If the two transfer functions $F_1$ and $F_2$ of the feedback paths 22 and 24 are similar, it goes without saying that both have a significant effect on the stability threshold.

By contrast, if the summands $C_1$ and $C_2$ are less than 1, the system 10 is more stable than a system with a single omnidirectional microphone. Then the amplifier 50 can amplify the signal to a greater extent than in the case of a hearing aid with a single microphone. Both summands $C_1$ and $C_2$ are dependent on the weighting factor a for the anti-cardioid branch 46 and on the frequency w. Depending on the weighting factor a, the critical gain value is greater than in the case of a hearing aid with only a single, omnidirectional microphone. In such a case the hearing aid 12 can provide a correspondingly increased gain without causing feedback in the process.

The overall transfer function allows a calculation of a maximum weighting factor a for the anti-cardioid branch 46, up to which maximum weighting factor a substantially feedback-free operation of the hearing aid 12 is possible. This calculation requires a measurement of the transfer functions $F_1$ and $F_2$ of the feedback paths 22, 24. Transfer functions $F_1$ and $F_2$, and further transfer functions for the individual feedback paths, can for example be established by virtue of the fact that an aid wearer wears a hearing device destined for use by him/her as envisaged and test measurements are carried out, for example by an audiologist. Using the transfer functions of the feedback paths established thus then affords the possibility of establishing e.g. an interval $a<a_0$ of values which allow feedback-reduced operation.

During operation, the weighting factor a can then be restricted to the maximum value $a_0$, i.e. to the upper boundary of the established interval. An aid wearer then perceives such a restriction as reduced directivity in those situations in which feedback can be expected.

Calculating a spacing of the weighting factor a from the maximum permissible value $a_0$ can also be used to control an algorithm for feedback suppression. If the weighting factor a is set to a value in the vicinity of the maximum permissible value $a_0$ at any particular time, a relatively small change in the weighting factor a may already lead to an unstable system. The instability can likewise be caused by a small change in the transfer functions $F_1$ or $F_2$. If the system 10 is in the vicinity of such a stability threshold, an adjustment speed of the algorithm for feedback suppression may be increased. Should feedback then actually occur in this case, it is suppressed particularly quickly by the algorithm.

An algorithm for feedback suppression can also be provided with identification or detection means for feedback. Such identification forms the basis of allowing an adaptive restriction of the weighting factor a. If feedback is identified, a boundary for the weighting factor a can be reduced. This then also reduces the current value of the weighting factor a to the extent that the system is once again stable. Then the feedback decays of its own accord. If no renewed feedback is subsequently detected for a predetermined amount of time, the boundary for the weighting factor a may be increased again. Prescribing appropriate time constants in the case of such an adaptive restriction can ensure that there is no cyclic repetition of feedback. The adaptive adjustment of the weighting factor a for the anti-cardioid branch 46 by means of the algorithm for the feedback suppression results in the advantage that a hearing aid always allows a correspondingly maximum possible value for the weighting factor a, even in changing surroundings.

A particular aspect of the invention is the option of mathematically determining a stability threshold for a system on the basis of the directional parameter a and the transfer functions $F_1$, $F_2$ for feedback paths. This affords the possibility of restricting the weighting factor a, and so a stable system is ensured at all times. In doing so, this also takes account of the amplification of the microphone signals, which is prescribed by e.g. a hearing curve of an aid wearer.

In conjunction with an algorithm for feedback suppression, there moreover are options of adjusting the restriction in an adaptive fashion during operation of the hearing aid when sound is amplified in a critical fashion. By appropriately aligning notches in the directional characteristic, a particularly high gain may also be obtained for a hearing aid with directivity, which gain is available to hearing aids with merely a single, omnidirectional microphone. Here, a notch in a directional characteristic is such a registering direction that has comparatively strong damping.

Figure 3:
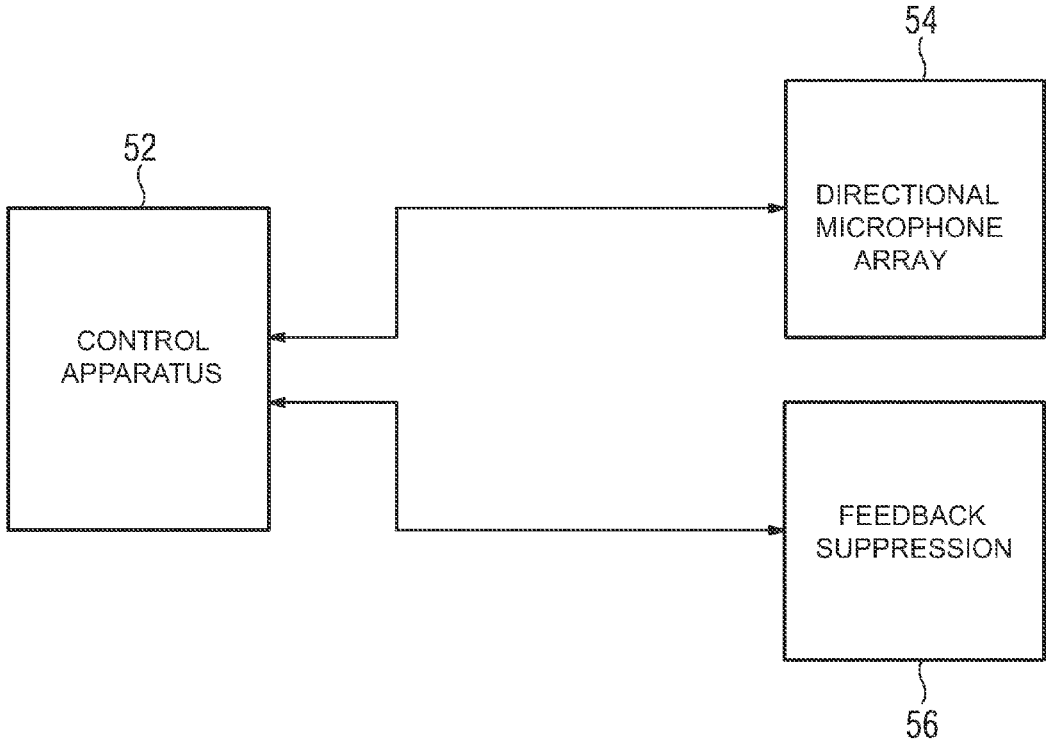
FIG. 3 shows a block diagram for the basic functionality of an exemplary embodiment of a hearing device according to the invention.

FIG. 3 shows a control apparatus 52, a directional microphone apparatus 54 and an apparatus for suppressing feedback, i.e. a feedback suppression means 56. The three apparatuses 52, 54, 56 can be provided as programs on a signal-processing processor of a hearing device. By way of example, the directional microphone apparatus 54 can process signals from a microphone array as described in conjunction with the apparatus 32 in order to generate a directional characteristic for the microphone array. The feedback suppression means 56 can for example be designed to estimate transfer functions of feedback paths in order to generate a compensation signal on the basis of the estimated transfer function, which compensation signal can damp an acoustic feedback signal.

The directional microphone apparatus 54 and the feedback suppression means 56 are each coupled to the control apparatus 52. The control apparatus 52 can be used to set a directional parameter of the directional microphone apparatus 54. Moreover, an increment for an adaptation algorithm of the feedback suppression means 56 can be set by the control apparatus 52. Conversely, current values of these parameters can also be read out of the directional microphone apparatus 54 and the feedback suppression means 56. Additionally, the estimated transfer functions for the feedback paths can also be read out of the feedback suppression means 56.

The control apparatus 52 is designed to use these values to control the directional parameter or the increment, as described in conjunction with FIG. 2. This allows the hearing device to control the directional microphone apparatus 54 and/or the feedback suppression means 56 in an appropriate fashion for preventing or suppressing acoustic feedback. In particular, this can afford the possibility of setting the directional characteristic in a flexible fashion according to the requirements of a wearer of the hearing device and, in the process, accordingly controlling the increment of the adaptation algorithm of the feedback suppression means 56 in order to suppress possible feedback. However, it is likewise made possible to avoid feedback effectively and/or to suppress feedback that has occurred by setting the directional characteristic by an appropriate control of the directional microphone apparatus 54.

The invention claimed is:

1. A method for operating a hearing device having a microphone array and the microphone array having a directional characteristic determined by a settable directional parameter, the method which comprises:

prescribing a stability condition, depending on the directional parameter, for feedback-reduced operation of the hearing device;

establishing those values of the directional parameter that satisfy the stability condition;

operating the hearing device and thereby restricting possible values for the directional parameter during operation of the hearing device to the established values.

2. The method according to claim 1, which comprises:

prescribing a term of a denominator of an overall transfer function, the term including at least the directional parameter and a transfer function of a feedback path; and establishing those values for the directional parameter that satisfy as a stability condition that the term satisfies a predetermined criterion.

3. The method according to claim 1, wherein the establishing step comprises establishing the values as a function of a frequency of a signal.

4. The method according to claim 2, which comprises forming the overall transfer function is formed as a fraction A/B, with $$A=[1-\exp(-j\omega(\tau_e+\tau_i))]H_c \text{ and}$$

$$B=1-H_c[F_1(1+a\exp(-j\omega\tau_i))-F_2(a+\exp(-j\omega\tau_i))];$$

wherein:

$F_1$ is a transfer function of a first feedback path;

$F_2$ is a transfer function of a second feedback path;

HC is a gain function of the hearing device;

$\omega$ is a frequency of a signal;

$\tau_i$ is a delay time and a is a weighting factor forming the directional parameter, the delay time and the weighting factor being the factors fixing the directional characteristic of the microphone array; and $\tau_e$ is a run time of sound between two microphones of the microphone array.

5. The method according to claim 4, which comprises, in order to establish the values for the weighting factor a, carrying out a check whether a value of the term $H_c[F_1(1+a\exp(-j\omega\tau_i))-F_2(a+\exp(-j\omega\tau_i))]$ is less than a stability threshold.

6. The method according to claim 5, wherein the stability threshold is one.

7. A method for operating a hearing device, in which a directional parameter for fixing a directional characteristic of a microphone array can be set as a first parameter and a control parameter for controlling an apparatus for the purpose of feedback suppression can be set as a second parameter, the method which comprises:

prescribing a measure for a feedback effect;

establishing a value for the measure based on a current value of the directional parameter; and setting the first parameter as a function of the established value.

8. The method according to claim 7, which comprises:

prescribing a distance measure from a stability threshold, dependent on the directional parameter, as a measure for the feedback effect and setting an increment for an adaptation algorithm of the unit for the purpose of feedback suppression as the parameter, and thereby increasing an adaptation speed of the adaptation algorithm if the hearing device is operated in a vicinity of the stability threshold.

9. The method according to claim 7, which comprises analyzing, as a measure for the feedback effect, whether feedback is present and wherein the setting step comprises changing a current value of the directional parameter until a feedback effect drops below a prescribed threshold.

10. A hearing device, comprising:

a microphone array having a directional characteristic to be fixed by way of a directional parameter forming a first parameter;

an apparatus to be controlled by an adjustable control parameter for suppressing feedback in the hearing device, the control parameter forming a second parameter; and a control apparatus configured to operate the hearing device in accordance with the method of claim 1.

11. The hearing device according to claim 10, wherein the directional characteristic of said microphone array is generated by a superposition of a cardioid directional characteristic and an anti-cardioid directional characteristic, and the anti-cardioid directional characteristic component is determined by the directional parameter.

12. A hearing device, comprising:

a microphone array having a directional characteristic to be fixed by way of a directional parameter forming a first parameter;

an apparatus to be controlled by an adjustable control parameter for suppressing feedback in the hearing device, the control parameter forming a second parameter; and a control apparatus configured to operate the hearing device in accordance with the method of claim 7.

13. The hearing device according to claim 12, wherein the directional characteristic of said microphone array is generated by a superposition of a cardioid directional characteristic and an anti-cardioid directional characteristic, and the anti-cardioid directional characteristic component is determined by the directional parameter.

* * * * *